US006019527A

United States Patent [19]

Green

[11] Patent Number: 6,019,527

[45] Date of Patent: Feb. 1, 2000

[54] METHOD OF OPERATING A THERMAL PRINTER

[75] Inventor: Michael Cameron Green, Crawley, United Kingdom

[73] Assignee: ITW Limited, Swansea, United Kingdom

[21] Appl. No.: 08/951,012

[22] Filed: Oct. 15, 1997

[51] Int. Cl.[7] ..... B41J 33/54

[52] U.S. Cl. ..... 400/208; 400/217

[58] Field of Search ..... 400/208, 217, 400/229

[56] References Cited

U.S. PATENT DOCUMENTS

| | | | |
|---|---|---|---|
| 4,008,795 | 2/1977 | Garberi et al. | 197/161 |
| 4,528,576 | 7/1985 | Koumura et al. . | |
| 4,542,997 | 9/1985 | Matsushima . | |
| 4,543,001 | 9/1985 | Tanaka et al. . | |
| 4,544,291 | 10/1985 | Nagata et al. . | |
| 4,563,691 | 1/1986 | Noguchi et al. . | |
| 4,568,210 | 2/1986 | Privitera . | |
| 4,614,949 | 9/1986 | Hakkaku et al. . | |
| 4,625,218 | 11/1986 | Watanabe . | |
| 4,641,149 | 2/1987 | Suzaki et al. . | |
| 4,642,656 | 2/1987 | Shibuya et al. . | |
| 4,661,003 | 4/1987 | Okamori . | |
| 4,707,153 | 11/1987 | Nishi et al. . | |
| 4,717,924 | 1/1988 | Bangs et al. . | |
| 4,735,519 | 4/1988 | Tanaka . | |
| 4,740,092 | 4/1988 | Applegate et al. . | |
| 4,836,698 | 6/1989 | Takagi et al. | 400/208 |
| 4,929,099 | 5/1990 | Graham et al. . | |
| 4,933,867 | 6/1990 | Ishigaki . | |
| 4,952,085 | 8/1990 | Rein . | |
| 4,969,127 | 11/1990 | Gilham . | |
| 5,001,498 | 3/1991 | Shimizu et al. . | |
| 5,094,555 | 3/1992 | Suzaki et al. . | |
| 5,121,136 | 6/1992 | Kawakubo . | |
| 5,153,606 | 10/1992 | Bas . | |
| 5,162,815 | 11/1992 | Hodge . | |
| 5,369,422 | 11/1994 | Yoshida et al. . | |
| 5,372,439 | 12/1994 | Poole et al. . | |
| 5,415,482 | 5/1995 | Poole et al. . | |
| 5,429,441 | 7/1995 | Schulz et al. . | |
| 5,429,443 | 7/1995 | Kobayashi et al. . | |
| 5,445,463 | 8/1995 | Paranjpe . | |
| 5,448,283 | 9/1995 | Takeuchi . | |
| 5,478,159 | 12/1995 | Schneider et al. . | |
| 5,481,291 | 1/1996 | Ishida et al. . | |
| 5,611,629 | 3/1997 | Paranjpe . | |

FOREIGN PATENT DOCUMENTS

| | | |
|---|---|---|
| 0173144 | 3/1986 | European Pat. Off. . |
| 0423647 | 4/1991 | European Pat. Off. . |
| 0683055 | 11/1995 | European Pat. Off. . |
| 0734876 | 10/1996 | European Pat. Off. . |
| 58-153666 | 9/1983 | Japan . |
| 2272669 | 5/1994 | United Kingdom . |
| 2289652 | 11/1995 | United Kingdom . |

*Primary Examiner*—John Hilten
*Attorney, Agent, or Firm*—Schwartz & Weinrieb

[57] ABSTRACT

In a thermal printer in which ink is transferred from a single-use thermal print ribbon to a substrate such as packaging material by energizing selected print elements of a thermal print head (22), a first print run is executed by energizing only a group of print elements in registry with one half of the ribbon width so that ink is depleted from only one half of the ribbon, and a second print run is executed by energising the same group of elements using the same ribbon but with the ribbon supply and take-up spools interchanged in order that ink is depleted only from the other half of the ribbon. This allows printing on comparatively narrow printing areas using ribbon which is at least twice the width of the printed area without undue ribbon wastage and with reduced ribbon breakage frequency compared to the breakage frequency with a ribbon of a width nearer to the width of the printed area.

14 Claims, 5 Drawing Sheets

METHOD OF OPERATING A THERMAL PRINTER

FIELD OF THE INVENTION

This invention relates generally to a method of operating a thermal printer and more particularly to a method of operating a thermal printer in which ink is transferred to a substrate from a thermal print ribbon.

BACKGROUND OF THE INVENTION

European Patent Specification No. 0734876A discloses a thermal printer for printing information such as dates and bar codes on packaging material, label-bearing films and other substrates by the thermal transfer of ink from a thermal print ribbon using a thermal print head having a line of selectively energizable print elements which are brought to bear against a moving ribbon with the ribbon being sandwiched between the print head and the substrate which is to bear the printed information. Conventionally, the ribbon is fed to the printing region from a supply spool by means of one or more deflection rollers, and is collected by means of one or more additional deflection rollers on a take-up spool, and once the full length of the ribbon is depleted of ink, a new spool of unused ribbon is mounted to the machine. To ease the ribbon replacement operation, spindles for receiving the supply and take-up spools are mounted on a removable cassette unit which includes the above-mentioned deflection rollers. Ribbon replacement is effected by removing the cassette unit from the printer body, removing the supply and take-up spools from the cassette unit, fitting a new supply spool with unused ribbon to the relevant spindle on the cassette unit, threading the free end of the ribbon around the deflection rollers and on to an empty take-up spool, and then sliding the cassette unit back onto the printer body, whereby the ribbon automatically takes up the correct position with respect to the thermal print head and the path of travel of the substrate material.

Ribbons of different widths may be used, depending on the transverse width of the area to be printed, that is in the direction transversely of the ribbon. However, the applicants have found that the tendency for the ribbon to break increases as the ribbon width is reduced. In addition, excessive compression of the take-up spool can occur, leading to difficulty in removing it from the printer.

OBJECT OF THE INVENTION

It is an object of the present invention to provide an improved method of operating a thermal printer which reduces the incidence of ribbon breakage and increases the usage of a printer ribbon.

SUMMARY OF THE INVENTION

According to a first aspect of this invention, there is provided a method of operating a thermal printer in which ink is transferred to a substrate from a single-use thermal print ribbon fed along a ribbon path from a supply position on a ribbon-mounting structure of the printer by means of a printing region to a take-up position on the ribbon-mounting structure, the ink transfer being performed by energizing selected print elements of a thermal print head located in the printing region and on the opposite side of the ribbon from the substrate with the print elements arranged in an array extending transversely with respect to the ribbon, wherein the method comprises: mounting an unused reel of ribbon at the supply position with one edge of the ribbon adjacent the ribbon-mounting structure, the ribbon being wound on a first spool; performing a first print run in which the ribbon is fed from the first spool through the printing region to a second spool mounted at the take-up position, and in which only those print elements in registry with part of the width of the ribbon are energized such that ink is depleted only in a longitudinal strip of the ribbon, the strip width being no greater than one half of the ribbon width; removing the second spool bearing the partly depleted ribbon from the take-up position and mounting it at the supply position with the said one edge of the ribbon remote from the ribbon mounting structure; and performing a second print run at which the ribbon is fed from the second spool through the printing region to a spool mounted at the take-up position, and in which only those print elements in registry with the undepleted part of the ribbon are energized for depleting ink in that part of the ribbon.

Preferably, print elements energized in the first print run are confined to a group of elements so as to which is in registry with a first half of the ribbon width adjacent a first edge of the ribbon, and the elements energized in the second run are confined to the same group of elements so as to thereby to deplete ink in the second half of the ribbon adjacent its second edge. The above group of elements may be of such an extent and position with respect to the ribbon as to define an ink depletion strip which is between the respective ribbon edge and a center line of the ribbon, and spaced from both that edge and the center line by respective guard bands.

This allows printing on comparatively narrow printing areas using ribbon which is at least twice the width of the printed area without undue ribbon wastage and with reduced ribbon breakage frequency compared to the breakage frequency with a ribbon of a width nearer to the width of the printed area. In addition, since it is not necessary for the operator to collect a new, unused ribbon between each print run, printer down-time is saved.

In the conventional use of a thermal printer, it is normal to confine the energized print elements to a width which is somewhat less than the total width of the ribbon so as to provide guard bands adjacent each edge of the ribbon, thereby allowing for ribbon alignment tolerances. When the printer is used in accordance with the above-described method, the guard band adjacent the center line of the ribbon may be much reduced in width, effecting a further reduction in ribbon wastage.

It will be appreciated that use of the preferred method in accordance with this invention will result in at least half of the print head elements remaining unenergized throughout operation of the printer. To make better use of the print head, it is possible within the scope of the invention to reconfigure the printer after a predetermined period so as to use a second group of print head elements and to shift the relative position of the printer with respect to the substrate so that the printing location on the substrate remains the same. In this way, a first series of first and second print runs may be performed until the energized print elements show signs of wear, then the printer may be reconfigured and shifted so as to use the so far unenergized print elements until they, too, show signs of wear, whereupon the print head is replaced. Thus, it is possible to double the useful life of the print head.

According to a second aspect of the invention there is provided a method of operating a thermal printer in which ink is transferred from a single-use thermal print ribbon to a substrate by energising selected print elements of a thermal print head and simultaneously causing relative movement between (a) the print head and (b) the ribbon and the substrate, wherein for successive print runs the selected print elements are confined to a group of print elements arranged in a line extending transversely of the ribbon over no more than one half of the width of the ribbon, so that in a first print run in which the ribbon is fed from a first spool acting as a supply spool to a second spool acting as a take-up spool ink is depleted from only one half of the ribbon, wherein the second spool is then removed, turned through 180° so as to invert the ribbon and mounted in place of the first spool to act as a new supply spool, and wherein a second print run is performed using the same group of print elements, ribbon being fed from the new supply spool to a new take-up spool, thereby to depleting ink from the other half of the ribbon.

The invention also includes a thermal printer for carrying out any of the above described methods, the printer including means confining energisation of the print elements to only those print elements in registry with part of the width of the ribbon, the said part having a width no greater than one half of the width of the ribbon.

BRIEF DESCRIPTION OF THE DRAWINGS

Various other objects, features, and attendant advantages of the present invention will be more fully appreciated from the following detailed description when considered in connection with in which like reference characters designate like or corresponding parts throughout the several views, and wherein.

DETAILED DESCRIPTION OF PREFERRED EMBODIMENTS

Figure 1:
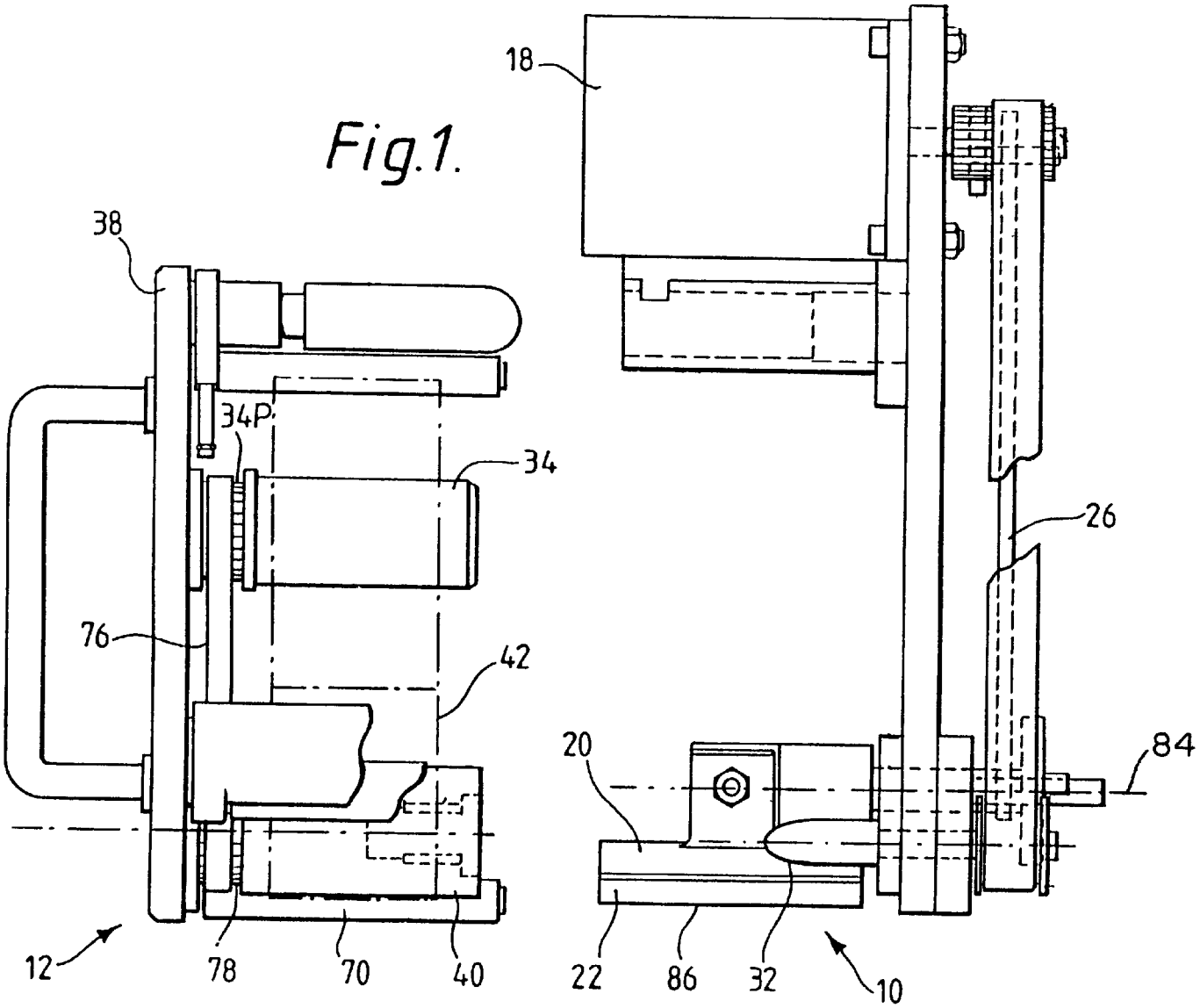
FIG. 1 is a diagrammatic exploded side view of a thermal printer for performing a printing method in accordance with the invention.
Figure 2:
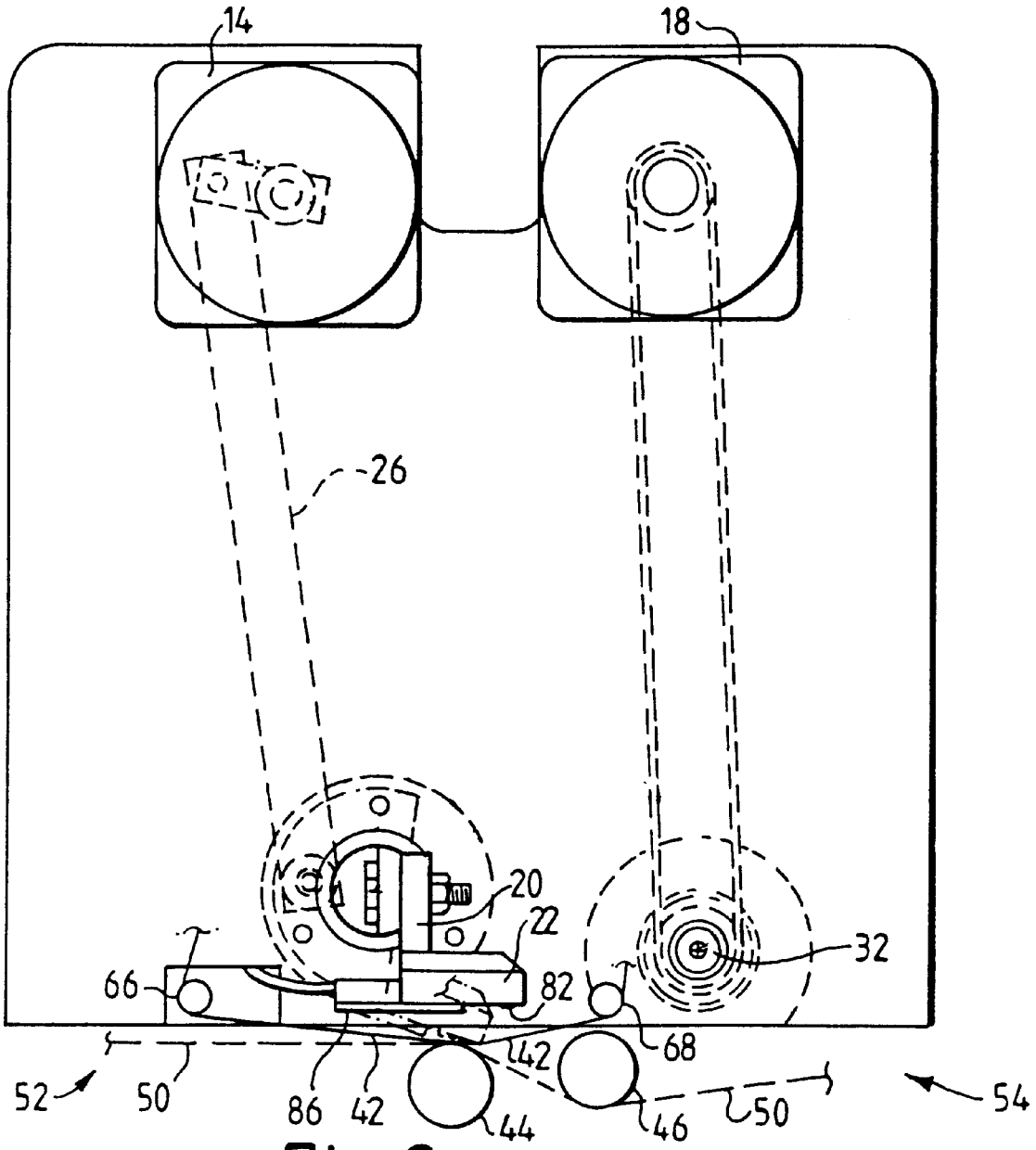
FIG. 2 is a front view of a base unit of the printer of FIG. 1.
Figure 3:
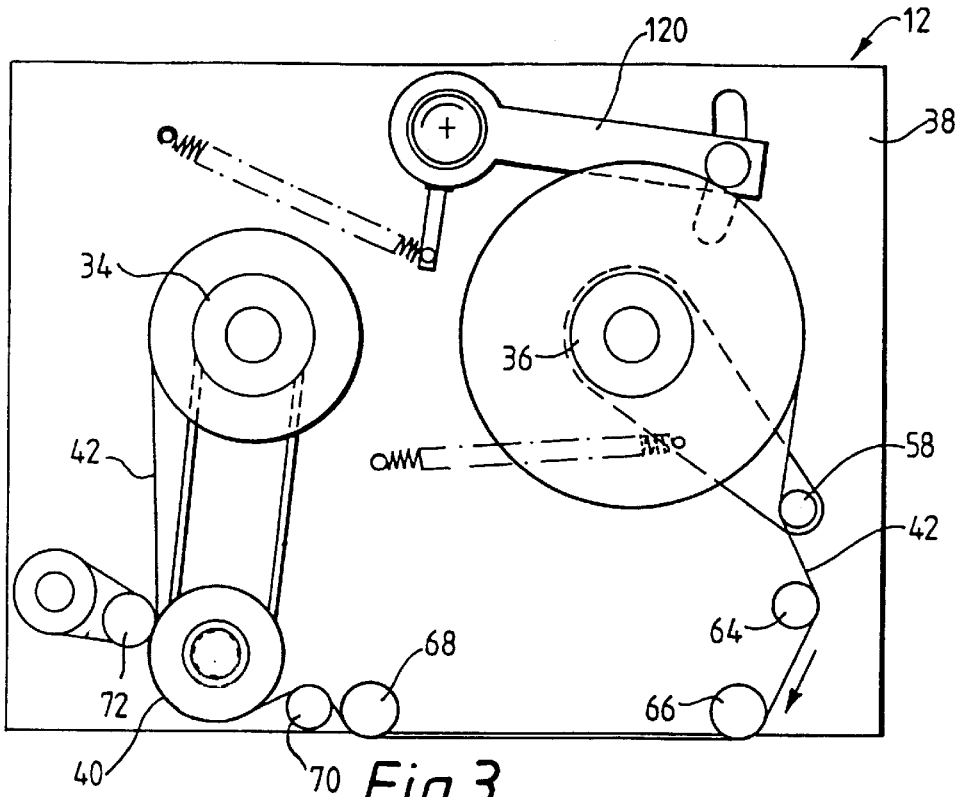
FIG. 3 is a rear view of a ribbon cassette unit of the printer of FIG. 1.

Referring to FIGS. 1, 2, and 3 together, a printer for the continuous printing of a continuous print medium by transfer from a thermal transfer print ribbon has a base unit and a removable ribbon cassette unit 12. The base unit, which is mounted to a frame of the printer (not shown) contains a print head stepper motor 14 and a ribbon drive stepper motor 18. A pivotable print head carrier 20 supports a print head 22 and is coupled to the motor 14 by means of a parallelogram linkage including a connection link 26.

Ribbon spools 34, 36 are detachably and rotatably mounted on a front plate 38 of the cassette unit 12, and when the cassette unit 12 is fitted to the base unit 10, they are coextensive with the print head 22 in terms of their location in a direction perpendicular to the plate 38. Also attached to the cassette unit front plate 38 is a ribbon drive roller 32 visible in FIG. 1 below ribbon spool 34, and also in FIG. 2.

The relative positioning of the ribbon spools 34, 36, the print head 22, and a ribbon drive roller 32 may be ascertained by comparison of FIG. 1 with FIG. 3. The ribbon 42 itself is shown in full lines in FIG. 3, but in phantom lines in FIG. I for clarity.

A platen roller 44 and a deflection roller 46 shown in FIG. 2 are mounted on the printer frame or other apparatus with which the printer is associated.

Referring to FIG. 2, a continuous film substrate 50 on which information is to be printed enters the printer in an inlet region 52, passes over and wraps around the platen roller 44, from where it follows a downward inclined path to so as pass underneath and wrap around the deflection roller 46 before passing to an outlet region 54 of the printer.

Both platen roller 44 and deflection roller 46 have axes of rotation which extend at right angles to the direction of travel of the substrate 50.

The thermal transfer ribbon 42 travels in the same direction as the substrate 50 and follows a ribbon path from supply spool 36 by means of deflector rollers 58, 64, and 66, thence through a printing region which, when the cassette unit 12 is loaded into the base unit 10, lies between the print head 22 and the platen roller 44. The ribbon 42 then passes over further additional guides 68, 70, and by means of drive roller 40 and pinch roller 72 onto the take-up spool 34, which is belt driven by a belt 76 from a pulley 78 mounted on the shaft of drive roller 40.

Where the ribbon 42 passes over the platen 44 roller, it is in frictional contact with the substrate film 50. The ribbon 42 is held in contact with the substrate film 50 only between the start and finish of each printing operation during which the lower surface of the print head 22 bears against the platen roller 44 through means of ribbon 42 and film 50 as shown in FIG. 2. At other times, the print head 22 is raised by operation of its stepper motor 14.

The print head 22 has side-facing printing elements 82 (FIG. 2) extending along a line parallel to the axis of rotation 84 of the print head carrier 20. These printing elements 82 project from a lower surface 86 of the print head 22. The ribbon 42 and the substrate film 50 are pinched between the print head 22 and the platen roller 44 precisely at the line of printing elements 82, and when these elements 82 are heated under electronic control and the film 50 and ribbon 22 are passed together in the same direction over the elements 82, ink is transferred from the ribbon 42 to the film 50 so as to print characters and symbols according to pre-programmed information incorporated in the signals fed to the print head 22.

An optical shaft encoder on a shaft bearing the platen roller 44 produces a signal representative of the speed of the film substrate 50 and by processing this output signal, the stepper motor 18 driving the ribbon drive roller 40 can be adjusted such that the ribbon 42 is driven at a required speed.

Figure 4:
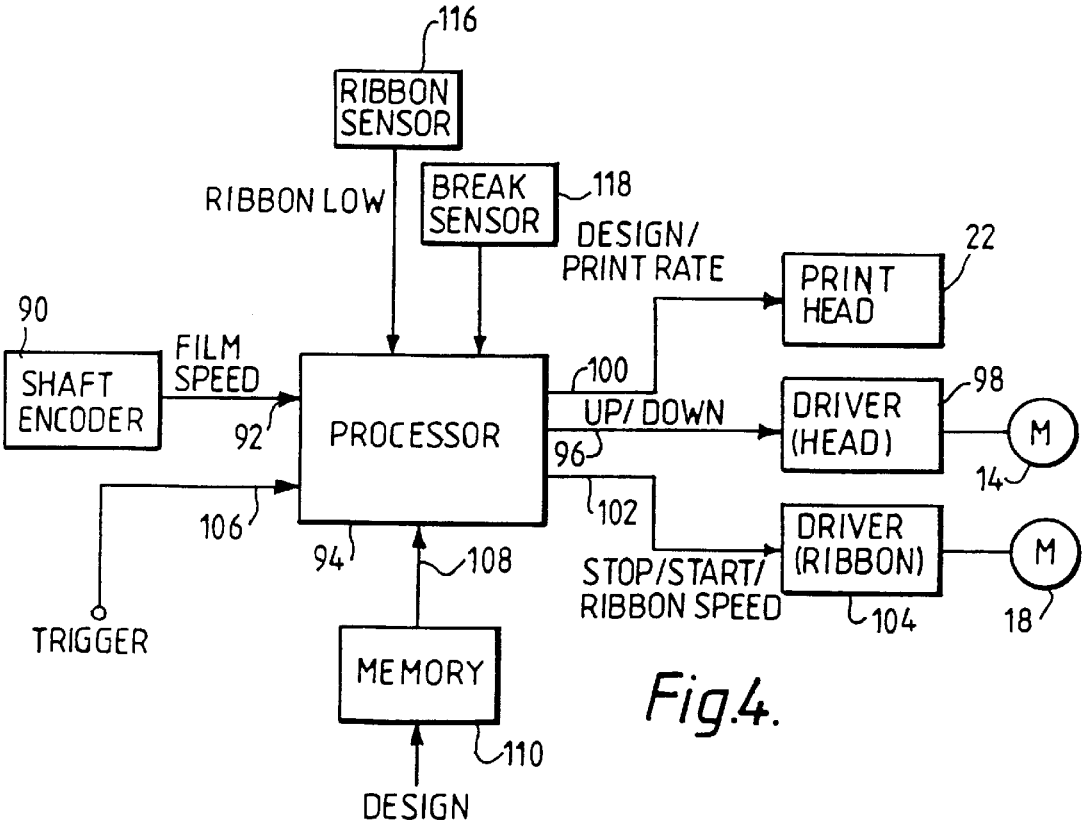
FIG. 4 is a block diagram of electrical parts of the printer.

The shaft encoder associated with the platen roller 44 is shown in FIG. 4 by reference numeral 90. Encoder 90 provides an input signal representative of film speed to an input 92 of a processor unit 94. The processor unit 94 has at its heart a microprocessor, and has three outputs comprising output 96 for a first motor driver circuit 98 for raising and lowering the print head 22, a second output which is a multiwire output 100 coupled to the energizable elements 82 of the print head 22, and a third output 102 for a ribbon motor driver 104 for controlling ribbon stepper motor 18.

Other inputs to the processor 94 include a trigger input 106 for receiving a trigger signal initiating each printing operation which is typically generated by sensing the position of products to which the substrate film 50 is to be applied as packaging as the products travel along an adjacent conveyor. Another input 108 receives the information to be printed from a memory 110 according to an input design. Thus, on receipt of a trigger signal at input 106, the processor 94 is programmed firstly to move the print head 22 to its extended position, to start the ribbon drive motor 18, and to initiate printing by energising the elements 82 of the print head 22 in accordance with the information stored in the memory 110 so as to thereby print the information as a pattern or a series of characters in a designated print area on the substrate film 50.

When the processor 94 senses that all the information relating to the required design has been supplied from memory 110 and has been fed to the print head 22, it issues a stop signal to the ribbon driver 104 to stop ribbon travel, and the driver 98 for the print head motor 14 receives a signal causing the motor to withdraw the print head 22 to its retracted, inactive position.

These operations are repeatedly performed on successive printing areas of the substrate 50 as part of a print run comprising many printing operations during which, the ribbon 42 is progressively fed from supply spool 36 to take-up spool 34. A ribbon status sensor 116 associated with a pivotable arm 120 (see FIG. 3) in the cassette unit 12 detects when the ribbon supply runs low so that an alarm can be activated and/or operation of the packaging apparatus of which the printer is a part can be halted. There is also a break sensor 118 responsive to excessive clockwise movement of arm 60 (see FIG. 3) to sense breakage of the ribbon 42.

The width of the ribbon 42 depends on the width of the area to be printed. However, in accordance with the invention, it is advantageous in the case of a comparatively narrow printed area to provide a ribbon 42 of a width which is at least twice the width of the printed area and then to use two longitudinal halves of the ribbon successively, as will now be explained with reference to FIGS. 5 to 7. By confining the energization of the elements 82 of the print head 22 to those elements 82 which are in registry with a strip of the ribbon 42 occupying one half of the ribbon width, it is possible to make a particularly economical use of the ribbon 42 in a way which minimizes ribbon breakage.

Figure 5:
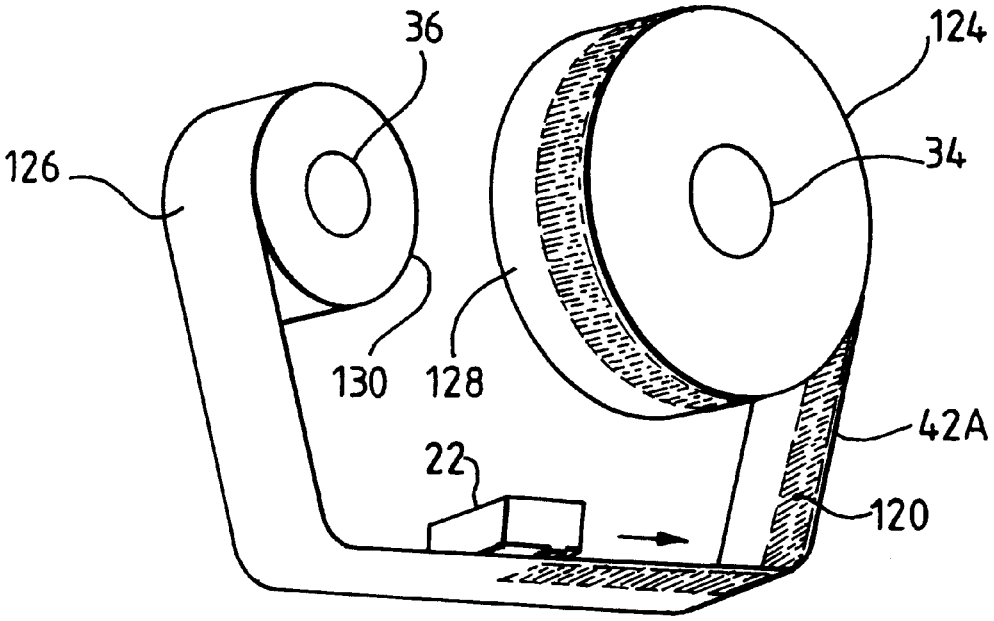
FIG. 5 is a simplified view of the printer ribbon during a first print run.
Figure 6:
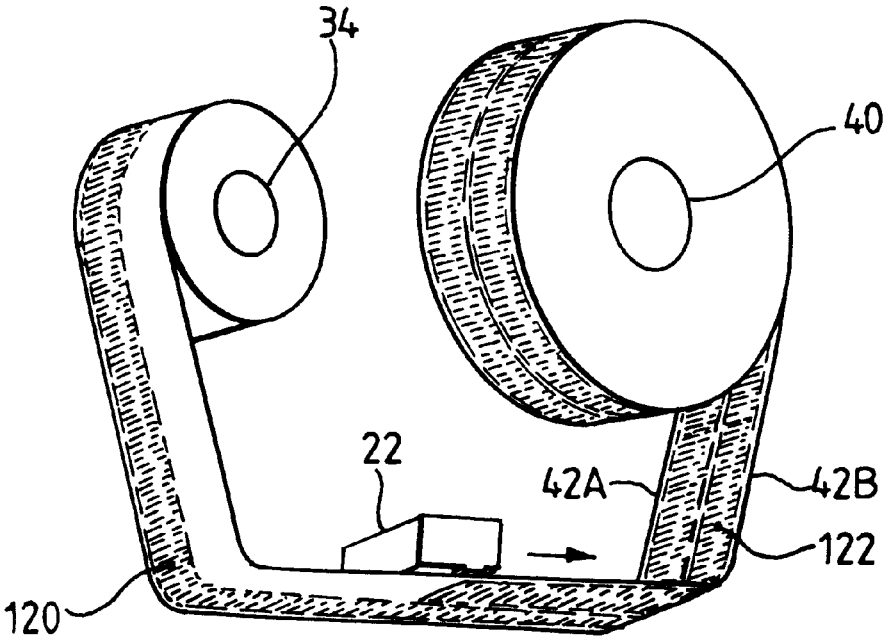
FIG. 6 is a simplified view of the ribbon during a second print run.

In a first print run, the limited transverse extent of the energized 82 elements creates a strip 120 of depleted ribbon which occupies just under one half of the width of the ribbon 42 adjacent a first edge 42A, as shown in FIG. 5. This mode of operation is continued until the supply spool 36 is exhausted and substantially all of the ribbon is wound onto the second spool 34, here acting as a take-up spool. At this point, the take-up spool 34 is removed from its mounting on the cassette unit 12, the empty supply spool 36 is also removed, and then the second spool 34 is turned through 180° about an axis perpendicular to its axis of rotation and placed on the spindle formerly occupied by the supply spool 36 so that the second spool 34 now becomes the new supply spool as shown in FIG. 6. Since the ribbon 42 has been inverted by the rotation of the spool 34 through 180°, the first edge 42A now lies in the opposite position with respect to its position during the first print run shown in FIG. 5, that is at the other end of the print head 22. The undepleted portion of the ribbon 42 wound on spool 34 is now available for printing, using the same group of printer head elements 82 as was used during the first print run.

Accordingly, a second print run may now be commenced, as shown in FIG. 6, whereby the above-mentioned group of elements 82 is in registry with the undepleted part of the ribbon 42 adjacent its second edge 42B, and printing may be carried on until the ribbon 42 is once again exhausted, this time the ribbon 42 being wound up on an empty spool 40 mounted on the cassette unit 12 in the position formerly occupied by the second spool 34, as shown in FIG. 6.

Figure 7:
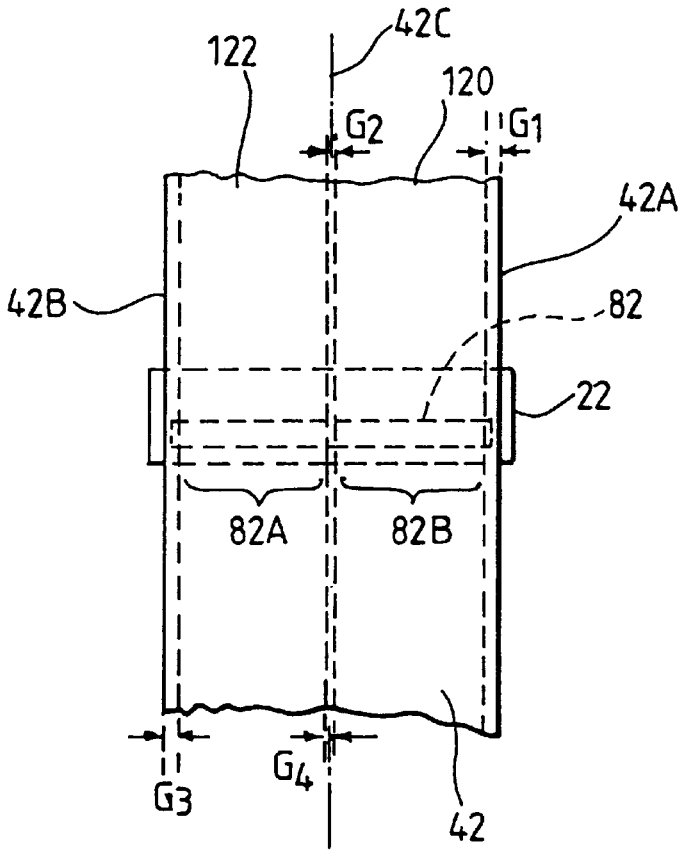
FIG. 7 is a diagram showing a portion of the ribbon and the manner in which ink is depleted from the ribbon.

The relative positions of those parts 120, 122 of the ribbon 42 depleted during the first and second print runs respectively is shown in FIG. 7. It will be seen that energization of the elements 82 during the first print run is such that a first guard band G1 and a second guard band G2 adjacent the first edge 42A of the ribbon 42 and the center line 42C of the ribbon 42 respectively are left undepleted during the first print run and, similarly, guard bands G3 and G4 adjacent edge 42B and center line 42C respectively are left undepleted during the second print run. Since guard bands G2 and G4 on either side of the center line 42C are remote from the edges of the ribbon 42, they may be much narrower than guard bands G1 and G3. This results in a particularly economical use of ribbon 42 in that, compared with printing from a narrow ribbon in the conventional way, a higher percentage of the ribbon area is used for printing.

It will be noted from the drawings that both the supply spool and the take-up spool rotate in the same direction throughout, in this case in an anticlockwise direction as seen in FIGS. 5 and 6. It will be appreciated that the path of the ribbon 42, instead of extending from the sides 124, 126 (see FIG. 5) of the ribbon reels which are remote from each other, may extend from the inner sides 128, 130, with the spools rotating in the clockwise direction. In the latter case, it is still possible to obtain the dual use of the ribbon illustrated in FIG. 6. The spools 34, 36 are open-ended in the sense that they may be mounted in either of two orientations on the printer mounting spindles, that is, with either end of the tubular core facing the ribbon mounting structure from which the spindles project.

For clarity, the print head 22 is shown diagrammatically in FIGS. 5 to 7. Referring to FIG. 7, the print head elements 82 are shown by dotted lines. FIG. 7 is, effectively, an underside view of the ribbon during the second print run, and also shows the print head elements 82A which are energized during the first and second print runs. As will be seen, these extend over no more than one half of the width of the ribbon 42.

Since according to the above-described method of use, the first and second print runs are performed with only elements of the group 82A being energized, it is possible to extend the life of the print head when it is used solely for printing in print areas of a width which is less than half of the ribbon width by using instead a second group 82B of elements when the elements of group 82A show signs of wear.

Figure 8:
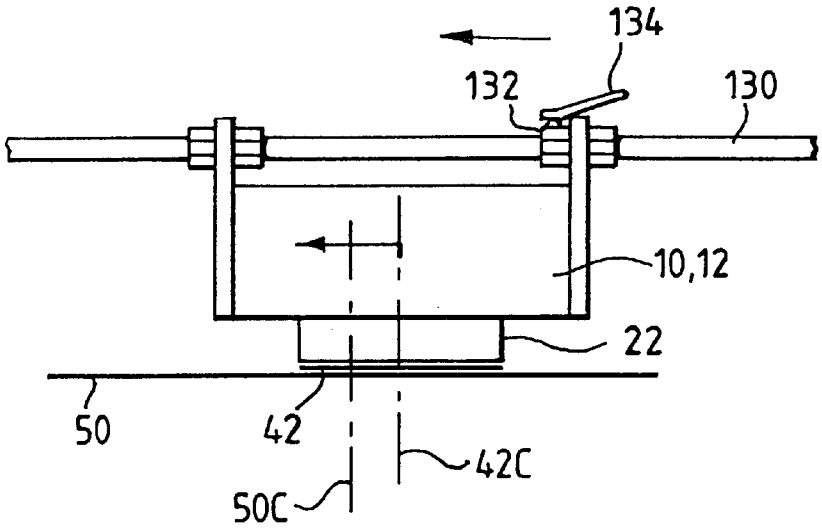
FIG. 8 is a simplified side view of the printer mounted in packaging apparatus.

This may be carried out by, firstly, moving the position of the design entered into memory 110 (see FIG. 4) so as to have coordinates corresponding to the half of the ribbon 42 which is shown as the rear half of FIG. 5. Concurrently with the repositioning of the design coordinates, the printer is moved on its mounting with respect to the apparatus in which it is positioned so that printing occurs in the same position on the substrate 50 as when the group 82A of printing elements 82 was used. This repositioning of the printer is shown diagrammatically in FIG. 8 in which the printer is shown by references 10, 12 and positioned above a substrate 50. Printer 10, 12 is mounted on support rails 130 associated with, for example, packaging apparatus by means of sliding bearings 132. The center line of a box image to be printed on the substrate 50 is indicated by reference 50C and with the printer 10, 12 in the position shown, the image is printed using the left-hand side of the print head 22 as seen in FIG. 8. When the print head elements 82 on the left-hand side of the print head 22 are worn, bearing lock 134 is released and printer 10, 12 is moved leftwards on rails 130 so that the center line 42C of the ribbon, 42 which is also the center line of the print head 22, is moved to the other side of the box image center line 50C, thereby bringing the elements 82 of the right-hand side of the print head 22 into registry with the box image position. The bearing lock 134 is then operated again to lock the printer 10, 12 in the new position on rails 130.

Throughout this description, reference has been made to a thermal printer in which the print head 22 remains fixed in its position longitudinally over the ribbon 42 and both the ribbon 42 and the substrate 50 move relative to the head 22 during printing. In particular, the substrate 50 is a continuous film of material which moves at a continuous rate. However, the invention may also be put into effect in an intermittent printer, that is one in which the substrate 50 and the ribbon 42 remain stationary during printing whilst the print head 22 is caused to move longitudinally of the ribbon 42 during each printing operation. The exchange and inversion of the ribbon spools is the same as described above.

Obviously, many modifications and variations of the present invention are possible in light of the above teachings. It is therefore to be understood that within the scope of the appended claims, the present invention may be practiced otherwise than as specifically described herein.

What is claimed is:

1. A method of operating a thermal printer, in which ink is transferred to a substrate from a single-use thermal print ribbon which is fed along a ribbon path which extends from a supply position on a ribbon-mounting structure of the printer, through a printing region, and to a take-up position on said ribbon-mounting structure, the ink transfer being performed by energizing selected print elements of a thermal print head located within said printing region and on the side of said ribbon which is opposite said substrate, wherein said print elements are arranged in an array extending transversely with respect to said thermal print ribbon, comprising the steps of:

mounting an unused roll of thermal print ribbon upon a first spool at said supply position with a first edge of said thermal print ribbon disposed adjacent to said ribbon-mounting structure;

mounting a second spool at said take-up position;

performing a first print run in which said thermal print ribbon is fed from said first spool, through said printing region, and to said second spool mounted at said take-up position, and in which only those print elements of a first group of said print elements which are in registry with a first part of said thermal print ribbon which has a width which is not greater than one half of the width of said thermal print ribbon are energized such that ink is only depleted from a first half of said thermal print ribbon and along a first longitudinal strip which extends along said thermal print ribbon, which is adjacent to said first edge of said thermal print ribbon, and which has a width which is not greater than one half of the width of said thermal print ribbon;

removing said second spool bearing the partly depleted thermal print ribbon from said take-up position and mounting said second spool at said supply position with said first edge of said thermal print ribbon disposed remote from said ribbon mounting structure;

shifting said print head with respect to said printing region such that a second group of said print elements are now in registry with the undepleted part of said ribbon; and performing a second print run in which said thermal print ribbon is fed from said second spool, through said printing region, and to a spool mounted at said take-up position, wherein only those print elements of said second group of said print elements which are now in registry with said undepleted part of said thermal print ribbon are energized so as to deplete the ink, disposed upon said undepleted part of said thermal print ribbon, from a second half of said thermal print ribbon and along a second longitudinal strip which extends along said thermal print ribbon, which is adjacent to a second opposite edge of said thermal print ribbon, and which has a width which is not greater than one half of the width of said thermal print ribbon.

2. A method according to claim 1, wherein:

said print elements energized during said first print run are confined to said first group of said print elements which is in registry with said first half of said ribbon width which is disposed adjacent to said first edge of said ribbon; and said print elements energized during said second run are confined to said second group of print elements so as to thereby deplete ink from said second half of said ribbon which is disposed adjacent to said second opposite edge of said ribbon.

3. A method according to claim 2, wherein:

said first group of energized print elements is of such an extent and position with respect to said ribbon as to define said first longitudinal ink depletion strip which is interposed between said first ribbon edge and a center line of said ribbon and which is spaced from both said first ribbon edge and said center line of said ribbon by respective guard bands.

4. A method according to claim 3, wherein:

the width of the guard band adjacent to said center line of said ribbon is less than the width of the guard band adjacent to said first edge of said ribbon.

5. A method according to claim 4, wherein:

the center line guard band width is less than half of the first and edge guard band width.

6. The method as set forth in claim 1, wherein:

prior to performing said second print run, said first spool, from which said thermal print ribbon has been substantially depleted, is removed from said supply position and disposed at said take-up position so as to comprise said spool disposed at said take-up position and thereby serve as a take-up spool for said thermal print ribbon during said second print run.

7. The method as set forth in claim 6, wherein:

prior to performing said second print run, said first and second spools are respectively removed from their supply and take-up positions, turned through 180° so as to invert said thermal print ribbon, and respectively mounted in place of said second and first spools such that said second spool now serves as a new supply spool and said first spool now serves as a new take-up spool.

8. A method of operating a thermal printer, in which ink is transferred to a substrate from a single-use thermal print ribbon which is fed alone a ribbon path which extends from a supply position on a ribbon-mounting structure of the printer, through a printing region, and to a take-up position on said ribbon-mounting structure, the ink transfer being performed by energizing selected print elements of a thermal print head located within said printing region and on the side of said ribbon which is opposite said substrate, wherein said print elements are arranged in an array extending transversely with respect to said thermal print ribbon and wherein the width of said array of print elements corresponds substantially to the width of said thermal print ribbon comprising the steps of:

mounting an unused roll of thermal print ribbon upon a first spool at said supply position with a first edge of said thermal print ribbon disposed adjacent to said ribbon-mounting structure;

mounting a second spool at said take-up position;

performing a first print run in which said thermal print ribbon is fed from said first spool, through said printing region, and to said second spool mounted at said take-up position, and in which only those print elements of a first group of said print elements which are in registry with a first part of said thermal print ribbon which has a width which is not greater than one half of the width of said thermal print ribbon are energized such that ink is only depleted from a first half of said thermal print ribbon and along a first longitudinal strip which extends along said thermal print ribbon, which is adjacent to said first edge of said thermal print ribbon, and which has a width which is not greater than one half of the width of said thermal print ribbon;

removing said second spool bearing the partly depleted thermal print ribbon from said take-up position and mounting said second spool at said supply position with said first edge of said thermal print ribbon disposed remote from said ribbon mounting structure;

performing a second print run in which said thermal print ribbon is fed from said second spool, through said printing region, and to a spool mounted at said take-up position, wherein only those print elements of said first group of said print elements which are now in registry with said undepleted part of said thermal print ribbon are again energized so as to deplete the ink, disposed upon said undepleted part of said thermal print ribbon, from a second half of said thermal print ribbon and along a second longitudinal strip which extends along said thermal print ribbon, which is adjacent to a second opposite edge of said thermal print ribbon, and which has a width which is not greater than one half of the width of said thermal print ribbon;

repeating said first and second print runs such that a plurality of successive pairs of said first and second print runs are performed using said first group of said print elements, each pair of said first and second print runs being performed with a fresh thermal print ribbon;

subsequently reconfiguring said printer so as to use a second group of print elements, not including print elements of said first group of print elements, to perform a plurality of successive pairs of first and second print runs;

shifting the relative position of said thermal printer with respect to the substrate so as to properly position said second group of print elements with respect to the substrate and thereby compensate for the change in using said second group of print elements brought about by the reconfiguration of said printer; and performing first and second print runs using said second group of print elements in a manner similar to the use of said first group of print elements in connection with the first and second print runs performed by said first group of print elements, whereby the service life of said thermal print head is maximized.

9. The method as set forth in claim 8, wherein:

prior to performing each one of said second print runs, said first spool, from which said thermal print ribbon has been substantially depleted, is removed from said supply position and disposed at said take-up position so as to comprise said spool disposed at said take-up position and thereby serve as a take-up spool for said thermal print ribbon during each one of said second print runs.

10. The method as set forth in claim 9, wherein:

prior to performing each one of said second print runs, said first and second spools are respectively removed from their supply and take-up positions, turned through 180 so as to invert said thermal print ribbon, and respectively mounted in place of said second and first spools such that said second spool now serves as a new supply spool and said first spool now serves as a new take-up spool.

11. A thermal printer for transferring ink from a thermal print ribbon to a substrate so as to print an ink pattern upon the substrate, comprising:

a thermal print head comprising a plurality of print elements which are arranged in an array which extends transversely with respect to a thermal print ribbon;

means confining energization of said plurality of print elements to only those print elements comprising a first group of said plurality of print elements which are in registry with a part of said thermal print ribbon which has a transverse extent which is not greater than one half of the width of said thermal print ribbon such that during a first print run during which said thermal print ribbon is transported in a first run direction with respect to said first group of energized print elements and wherein only a first half of said thermal print ribbon, as considered in the widthwise direction thereof, is disposed in contact with said first group of energized print elements, ink is depleted from only said first half of said thermal print ribbon, whereas during a second print run during which said thermal print ribbon is again transported in said first run direction with respect to said first group of energized print elements and a second half of said thermal print ribbon, as considered in said widthwise direction thereof, is disposed in contact with said first group of energized print elements, ink is depleted from said second half of said thermal print ribbon as considered in said widthwise direction thereof;

means for reconfiguring said print elements of said thermal print head such that only a second group of said plurality of print elements, disposed within said transverse array of print elements and different from said first group of print elements, is able to be energized after the performance of printing operations during said first and second print runs; and means for shifting said thermal print head with respect to said thermal print ribbon from a first position, at which said first group of print elements is properly positioned with respect to said thermal print ribbon so as to transfer ink from said thermal print ribbon to the substrate during said first and second print runs, to a second position at which said second group of print elements is properly positioned with respect to said thermal print ribbon so as to transfer ink from said thermal print ribbon to the substrate during subsequent first and second print runs whereby the service life of said thermal print head is extended.

12. The thermal printer as set forth in claim 11, further comprising:

rail means for slidably supporting said thermal printer thereon; and releasable locking means for locking said thermal printer upon said rail means at either one of said first and second positions.

13. A thermal printer for transferring ink from a thermal print ribbon to a substrate so as to print an ink pattern upon the substrate, comprising:

a thermal print head comprising a plurality of print elements which are arranged in an array which extends transversely with respect to a thermal print ribbon;

means confining energization of said plurality of print elements to only those print elements comprising a first group of said plurality of print elements which are in registry with a part of said thermal print ribbon which has a transverse extent which is not greater than one half of the width of said thermal print ribbon such that during a first print run during which said thermal print ribbon is transported in a first run direction with respect to said first group of energized print elements and wherein only a first half of said thermal print ribbon, as considered in the widthwise direction thereof, is disposed in contact with said first group of energized print elements, ink is depleted from only said first half of said thermal print ribbon, whereas during a second print run during which said thermal print ribbon is again transported in said first run direction with respect to said first group of energized print elements and a second half of said thermal print ribbon, as considered in said widthwise direction thereof, is disposed in contact with said first group of energized print elements, ink is depleted from said second half of said thermal print ribbon as considered in said widthwise direction thereof;

means for reconfiguring said print elements of said thermal print head such that only a second group of said plurality of print elements, disposed within said transverse array of print elements and different from said first group of print elements, is able to be energized when said print elements of said first group of print elements exhibit wear after the performance of multiple printing operations during said first and second print runs; and means for shifting said thermal print head with respect to said thermal print ribbon from a first position, at which said first group of print elements is properly positioned with respect to said thermal print ribbon so as to transfer ink from said thermal print ribbon to the substrate during said first and second print runs, to a second position at which said second group of print elements is properly positioned with respect to said thermal print ribbon so as to transfer ink from said thermal print ribbon to the substrate during subsequent first and second print runs whereby the service life of said thermal print head is extended.

14. The thermal printer as set forth in claim 13, further comprising:

rail means for slidably supporting said thermal printer thereon; and releasable locking means for locking said thermal printer upon said rail means at either one of said first and second positions.

* * * * *